US009115866B2

(12) United States Patent
Hu et al.

(10) Patent No.: US 9,115,866 B2
(45) Date of Patent: Aug. 25, 2015

(54) LED UNIT WITH RECTANGULAR LENS

(71) Applicant: HON HAI PRECISION INDUSTRY CO., LTD., New Taipei (TW)

(72) Inventors: Chau-Jin Hu, New Taipei (TW); Feng-Yuen Dai, New Taipei (TW); Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 9 days.

(21) Appl. No.: 14/010,547

(22) Filed: Aug. 27, 2013

(65) Prior Publication Data

US 2015/0003078 A1 Jan. 1, 2015

(30) Foreign Application Priority Data

Jun. 28, 2013 (TW) ..... 102123137 A

(51) Int. Cl.
*F21V 5/04* (2006.01)
*F21K 99/00* (2010.01)
*F21Y 101/02* (2006.01)

(52) U.S. Cl.
CPC . *F21V 5/048* (2013.01); *F21K 9/50* (2013.01); *F21K 9/58* (2013.01); *F21V 5/04* (2013.01); *F21Y 2101/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,143,394 | A * | 3/1979 | Schoberl | 257/98 |
| 5,825,051 | A * | 10/1998 | Bauer et al. | 257/82 |
| 6,213,625 | B1 * | 4/2001 | Leadford et al. | 362/331 |
| 6,674,096 | B2 * | 1/2004 | Sommers | 257/98 |
| 7,390,109 | B2 * | 6/2008 | Li et al. | 362/296.07 |
| 7,422,357 | B1 * | 9/2008 | Chang | 362/602 |
| 7,726,828 | B2 * | 6/2010 | Sato | 362/97.3 |
| 7,833,811 | B2 * | 11/2010 | Han et al. | 438/27 |
| 8,556,452 | B2 * | 10/2013 | Simon et al. | 362/217.07 |
| 2005/0135109 | A1 * | 6/2005 | Stout | 362/509 |
| 2009/0323332 | A1 * | 12/2009 | Lo et al. | 362/235 |
| 2011/0141734 | A1 * | 6/2011 | Li et al. | 362/235 |

* cited by examiner

*Primary Examiner* — Ismael Negron
(74) *Attorney, Agent, or Firm* — Novak Druce Connolly Bove + Quigg LLP

(57) ABSTRACT

A lens includes a bottom face, a light incident face defined in the bottom face, a top face and four lateral faces interconnecting the top face and the bottom face. Each lateral face is perpendicular to two adjacent lateral faces, and parallel to an opposite lateral face. An LED unit incorporating the lens is also disclosed.

14 Claims, 2 Drawing Sheets

LED UNIT WITH RECTANGULAR LENS

BACKGROUND

1. Technical Field

The disclosure generally relates to lenses, and more particularly to a lens having a rectangular light pattern and an LED (light emitting diode) using the lens.

2. Description of Related Art

Nowadays LEDs (light emitting diodes) are applied widely in various applications for illumination. The LED is a highly pointed light source. Thus, light directly emitted from the LED may form a small circular light spot. In order to achieve a large illumination area, a large number of LEDs are arranged in a matrix. However, dark areas may appear between peripheries of the circular light spots generated by the LEDs, whereby the illumination provided by the LEDs is not uniform enough.

What is needed, therefore, is a lens with a rectangular light pattern and an LED unit using the lens which can address the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the various views.

DETAILED DESCRIPTION

Figure 1:
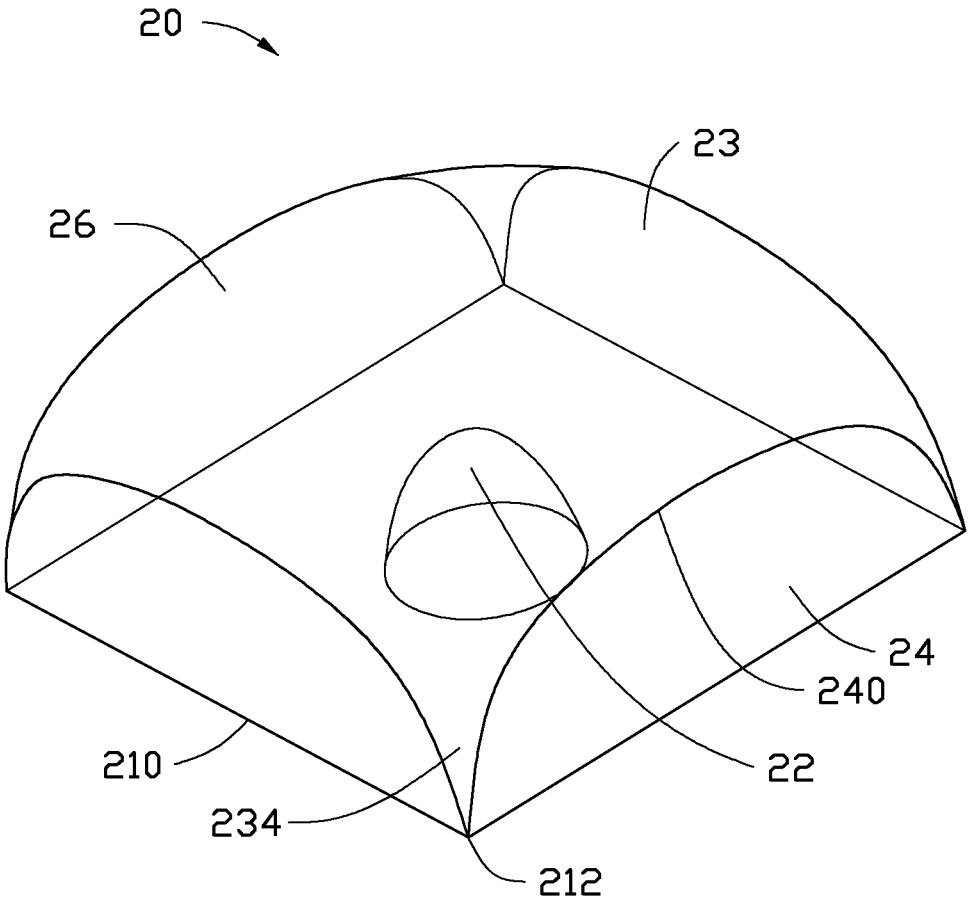
FIG. 1 shows a lens of an LED unit in accordance with an embodiment of the present disclosure.
Figure 2:
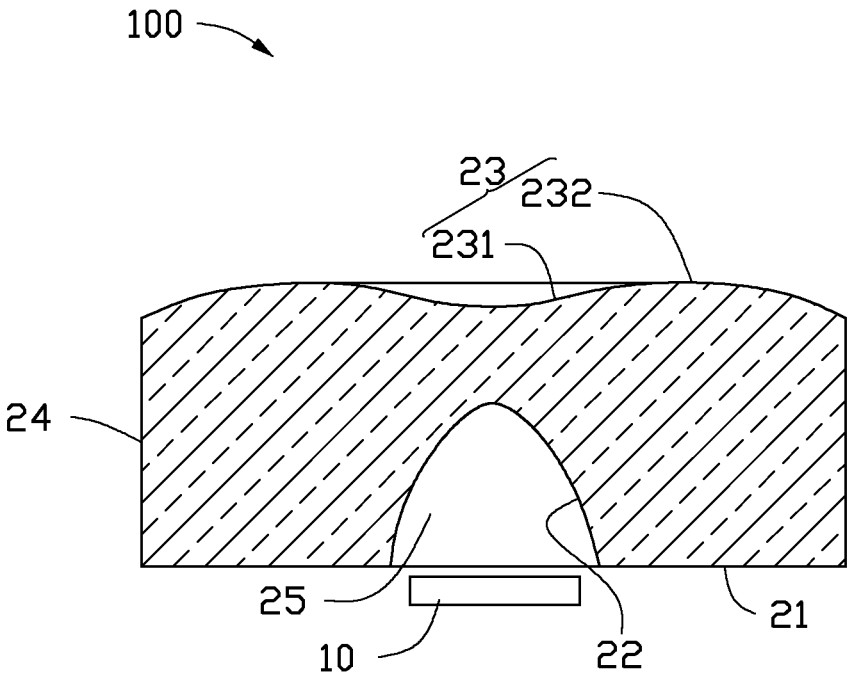
FIG. 2 shows a cross section of the lens of FIG. 1, wherein an LED is placed below the lens.

Referring to FIGS. 1-2, an LED (light emitting diode) unit 100 in accordance with an embodiment of the present disclosure is shown. The LED unit 100 includes an LED 10 and a lens 20 covering the LED 10.

The LED 10 may be made of GaN, InGaN, AlInGaN or other suitable semiconductor materials. The LED 10 can emit light when powered. Phosphor may be incorporated to the LED 10 for changing color of the light emitted from the LED 10. Preferably, the LED 10 emits white light.

The lens 20 may be made of transparent material such as epoxy, silicone, glass or the like. The lens 20 includes a bottom face 21, a light incident face 22 and a light emerging face 26. The bottom face 21 is square and has four straight edges 210. The light incident face 22 is formed in a central area of the bottom face 21. The light incident face 22 is an elliptical face with a long axis perpendicular to the bottom face 21 and a short axis located within the bottom face 21. The light incident face 22 encloses a cavity 25 in the lens 20. The cavity 25 is depressed from the bottom face 21 towards the light emerging face 26 of the lens 20. A diameter of the cavity 25 gradually increases towards the bottom face 21.

The light emerging face 26 includes a top face 23 and four lateral faces 24. The top face 23 is a smooth freeform face including a concave face 231 and a convex face 232 surrounding the concave face 231. The concave face 231 is located at a central area of the top face 23 and just above the light incident face 22. The convex face 232 smoothly connects the concave face 231. The convex face 232 includes four sharp corners 234 extending outwardly and downwardly. Each corner 234 of the convex face 232 has a width gradually decreasing in a direction towards the bottom face 21. A tip of each corner 234 of the convex face 232 directly connects a joint 212 of two adjacent edges 210 of the bottom face 21. In other words, the top face 23 directly connects the bottom face 21. The four lateral faces 24 are sandwiched between the top face 23 and the bottom face 21. Each corner 234 of the top face 23 is located between and directly connects two adjacent lateral faces 24. Each lateral face 24 is a flat face with a large amount of micro structures (such as protrusions or depressions). Thus, each lateral face 24 is rough for diffusing light passing therethrough. Each lateral face 24 is perpendicular to the bottom face 21. Each lateral face 24 is perpendicular to two adjacent lateral faces 24, and parallel to an opposite lateral face 24. Each lateral face 24 connects a corresponding edge 210 of the bottom face 21. That is to say, a boundary between each lateral face 24 and the bottom face 21 is a straight line. A boundary 240 between each lateral face 24 and the top face 23 is a curved line. Two adjacent curved lines connect the joint 212 of two corresponding adjacent edges 210 of the bottom face 21.

A part of the light emitted from the LED 10 is refracted by the light incident face 22 and the top face 23 to be diverged out of the lens 20, remaining part of the light emitted from the LED 10 is refracted by the light incident face 22 and diffused by the four lateral faces 24 out of the lens 20. Thus, the light emerging from the lens 20 can form a substantially rectangular pattern. When a plurality of the LED units 100 are used together, peripheries of the rectangular patterns produced by the LED units 100 can be connected to or overlapped with each other, thereby eliminating dark areas between the peripheries of the light patterns. The LED unit 100 may be suitable for use in a backlight module of a display.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lens comprising:

a bottom face;

a light incident face formed in the bottom face;

a top face; and four lateral faces connecting the top face with the bottom face;

wherein each lateral face is perpendicular to two adjacent lateral faces, and parallel to an opposite lateral face;

wherein the top face directly connects the bottom face.

2. The lens of claim 1, wherein the bottom face is rectangular.

3. The lens of claim 1, wherein the top face comprises a concave face and a convex face surrounding the concave face, the concave face being located above the light incident face.

4. The lens of claim 1, wherein each lateral face is perpendicular to the bottom face.

5. The lens of claim 1, wherein a boundary between each lateral face and the top face is curved.

6. The lens of claim 1, wherein the light incident face is defined in a central area of the bottom face.

7. The lens of claim 1, wherein the light incident face encloses a cavity in the lens.

8. An LED (light emitting diode) unit comprising:

an LED; and a lens comprising:

a light incident face; and a light emerging face comprising a top face and four lateral faces surrounding the top face;

wherein each lateral face is perpendicular to two adjacent lateral faces, and parallel to an opposite lateral face;

wherein the lens further comprises a bottom face directly connecting the top face, the four lateral faces being located between the top face and the bottom face.

9. The LED unit of claim 8, wherein each lateral face is perpendicular to the bottom face.

10. The LED unit of claim 8, wherein a boundary between each lateral face and the top face is curved.

11. The LED unit of claim 8, wherein the bottom face is a rectangular face having four edges.

12. The LED unit of claim 11, wherein the top face comprises four sharp corners each directly connecting a joint of two adjacent edges of the bottom face.

13. A lens comprising:

a bottom face;

a light incident face formed in the bottom face;

a top face; and four lateral faces connecting the top face with the bottom face;

wherein each of the four lateral faces is perpendicular to two adjacent lateral faces of the four lateral faces, and parallel to an opposite lateral face of the four lateral faces;

wherein the top face comprises four sharp corners directly connecting the bottom face.

14. The lens of claim 13, wherein the bottom face comprises four edges, and each corner of the top face is located between and directly connects two adjacent lateral faces.

* * * * *